United States Patent [19]

Harding

[11] Patent Number: 4,512,474

[45] Date of Patent: Apr. 23, 1985

[54] LOCKING MEANS FOR DISPLAY PACKAGE

[75] Inventor: LeRoy A. Harding, Glen Ellyn, Ill.

[73] Assignee: Plastofilm Industries, Inc., Wheaton, Ill.

[21] Appl. No.: 559,417

[22] Filed: Dec. 8, 1983

[51] Int. Cl.[3] ..... B65D 83/10

[52] U.S. Cl. ..... 206/461; 206/467; 206/470; 220/4 E; 220/306

[58] Field of Search ..... 206/461, 462, 463, 467, 206/470, 471; 220/4 E, 306; 229/2.5 R

[56] References Cited

U.S. PATENT DOCUMENTS

| | | | |
|---|---|---|---|
| 3,149,747 | 9/1964 | Burgess | 220/306 |
| 3,164,478 | 1/1965 | Bostrom | 229/2.5 R |
| 3,311,229 | 3/1967 | Troll et al. | 206/461 |
| 3,695,514 | 10/1972 | Mascetti, Jr. | 229/2.5 R |
| 3,786,982 | 1/1974 | Rakes et al. | 229/2.5 R |
| 4,368,840 | 1/1983 | Pardo | 229/2.5 R |
| 4,423,811 | 1/1984 | Knapp | 206/470 |
| 4,431,114 | 2/1984 | Kleinfield | 220/306 |

FOREIGN PATENT DOCUMENTS

| | | | |
|---|---|---|---|
| 453195 | 3/1968 | Switzerland | 229/2.5 R |

*Primary Examiner*—William T. Dixson, Jr.
*Assistant Examiner*—Brenda J. Ehrhardt
*Attorney, Agent, or Firm*—Lee, Smith & Zickert

[57] ABSTRACT

An improved locking means for display packages of the vacuum-formed type having a first section closable onto a second section to hold articles in an interior chamber formed therebetween and means for locking the sections in the closed position. The improvement comprises locking means having snap-engaging male and female portions. The male portion is formed integrally with the first section and has a negative or zero draft sidewall that terminates in an outwardly projecting widened collar at its crown. A female portion is formed integrally with the second section and has a zero draft sidewall having a narrowed rim around its receiving opening. The widened collar resiliently snap-engages with said narrowed rim at spaced-apart contact points therebetween. The improved locking means is capable of releasably locking a display package in the closed position.

12 Claims, 10 Drawing Figures

LOCKING MEANS FOR DISPLAY PACKAGE

BACKGROUND AND SUMMARY OF THE INVENTION

The invention relates to an improved means for releasably locking a display container of the type sometimes referred to as blister packaging. Particularly, the invention is directed toward releasably securing male and female portions to hold the package in a closed position for display and storage.

Plastic packages for exhibiting a wide variety of articles to be sold have long been used. Some have cardboard or paper backing adhered to the back of a plastic envelope formed in the shape of the goods. Others have front and back plastic sections which are detachably joined along a seam for separating the plastic halves and removing the item. The sections may be adhesively bonded or otherwise joined along the seam to maintain closure of the package. Oftentimes, metal or plastic fasteners and clips secure the package in the closed position.

Another type of plastic involves integrally molded front and back envelopes joined along a pivotable hinge portion. With this type package marginal edges of the front and back envelopes meet when the envelopes are pivoted to the closed position. These edges are typically fastened together mechanically or by adhesive bonding.

More sophisticated approaches to securing packages have included blister-type packs with integral snap-over edges or snap-together elements in which a resilient engagement is achieved. A problem with such fastening means is that very close mold tolerances must be maintained or else the molded fastening portions may not properly mate and securely hold. Since this type of plastic packaging is predominantly manufactured by vacuum, or thermo, forming, a great deal of expense is incurred in making molds which will produce the tolerances required. Thermo forming molds, especially the portions for forming the parts of fastening clasps were required to be precisely made for particular thicknesses of plastic film. Usually, plastic packs are made in the range of from about 19 gauge to about 31 gauge, and the particular thickness used depends upon the size, weight and shape of the article to be containerized. A resiliently engageable design may work well for one gauge but might not be usable with a different thickness. Snap-engagements are in large part reliant upon the modulus of elasticity of the material as well as accurate part dimensions. Thus, changes in the formulation of the plastic material may be required to enable a uniform fastener design to be useful over a range of thicknesses.

Another aspect of making vacuum formed plastic packages involves providing positive mold draft so that the formed item can be released from the mold. Consideration of the draft required at the engageable portions must be given when close tolerances for snap-fits are required. This problem is compounded when proper engagement requires a relatively sharp edged member on one half of the package to resiliently engage a complementary member on the other half. In the past, even these extra cost and design efforts required to form resiliently engageable members have not succeeded in achieving very effective fastening means.

It is therefore a primary goal of the invention to provide improved releasable locking means for plastic packaging, which does not require close mold tolerances to achieve secure resilient engagement.

An important goal of the invention is to provide plastic blister-type packaging having integrally formed resilient locking means of the clasp type, which comprises a zero draft female portion and a snap-engaging zero, or negative, draft male portion.

It is an allied goal to take advantage of a discovered phenomenon in vacuum forming plastics which creates a widened collar at the crown of the male portion and a narrowed rim at the opening of the female portion while the molten plastic is drawn to the mold and thereafter cooled. The collar and rim have been found to provide complementary shapes enabling an enhanced resilient engagement.

Yet another object of the invention is to provide male and female portions which resiliently contact at spaced-apart points during snap-engagement and disengagement.

A subservient goal is to form such locking means as integral portions of a hinged plastic package so that the locking means are manually engageable and disengageable to facilitate closing and opening of the package in a simple manner.

The invention can be summarized as providing an improved resilient locking means for thermo formed plastic packages or containers of the clasp type using "a round peg in a square hole". The improved locking means comprises vacuum forming at least one set of opposingly aligned male and female portions in the plastic sections. The male portion is formed with a zero or negative draft sidewall, circular in cross-section, and has a height no greater than the depth of the female portion. The female portion is formed with a zero draft sidewall which is polygonal in cross-section. During vacuum forming, the drawn molten plastic creates an outwardly projecting collar around the crown of the male portion and an inwardly projecting rim around the opening of the female portion. The uniquely formed collar being slightly larger in outside diameter than an opening bounded by the rim. The collar and rim have geometric outlines that permit them to resiliently snap-engage at symmetrically spaced-apart points. The resilient engagement releasably secures the formed plastic sections to each other. The male and female portions have a common central axis when engaged and the sidewall mold width of the female portion need only be roughly formed at about the same width as the mold for the male portion sidewall taken at the crown thereof.

DESCRIPTION OF BEST MODE EMBODYING THE INVENTION

Figure 1:
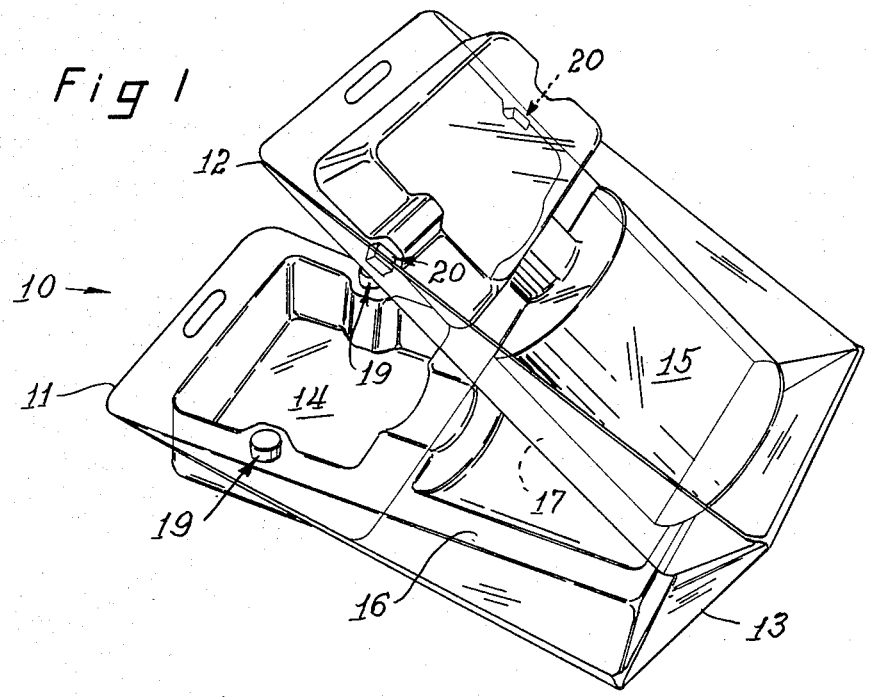
FIG. 1 is a perspective view of a hinged two-section package shown in the open position with the improved locking means of the invention being disengaged.
Figure 2:
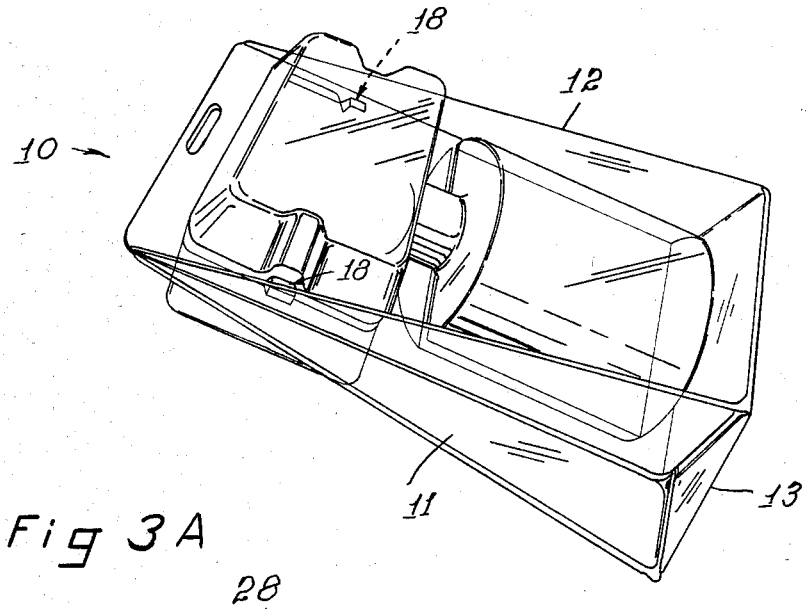
FIG. 2 is a perspective view of the package as shown in FIG. 1 but in the closed position with the improved locking means of the invention engaged.

With reference to FIGS. 1 and 2, a vacuum formed plastic package 10 comprises two sections 11, 12, which are joined at hinge 13. The sections 11, 12, opposingly face when closed (FIG. 2) and each accommodates parts of an article (not shown) in shaped recesses 14, 15, respectively. It will be understood that recesses 14, 15 are the "negatives" of the shape of the article to be containerized. The invention is applicable to packages of an infinite variety of shapes and is not limited to article conforming recesses.

Sections 11 and 12 include flat marginal edges 16 and 17, respectively. These edges flushly abut when package 10 is closed. Improved locking means 18 are provided at two locations along edges 16, 17. Each locking means includes a male portion 19 at edge 16, and female portion 20 at edge 17. Male portion 19 is vacuum formed to project from edge 16. Female portion 20 is vacuum formed from edge 17 and also projects, but away from edge 17 to provide a recess for receipt of male portion 19. Portions 19, 20 are in positional correspondence along the marginal edges upon pivoting sections 11, 12 into the closed relationship shown in FIG. 2. Stated another way, portions 19, 20 co-axially align at engagement.

Figure 3A:
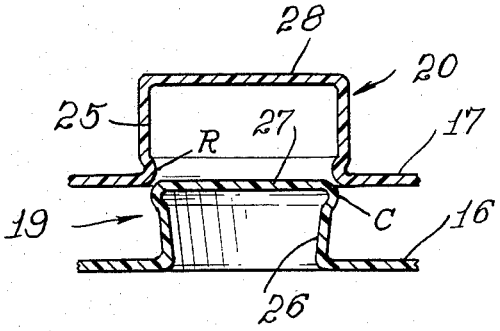
FIG. 3A is a sectional view of the improved locking means of FIG. 1 just prior to engagement of a zero draft female portion and negative draft male portion.
Figure 3C:
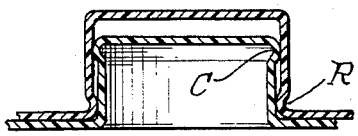
FIG. 3C is a sectional view, similar to FIG. 3B, but having a zero draft male portion in an alternate embodiment of the invention.
Figure 3B:
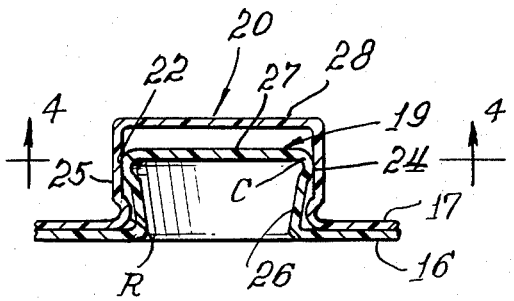
FIG. 3B is a sectional view of the same improved locking means upon engagement as shown in FIG. 2.
Figure 5:
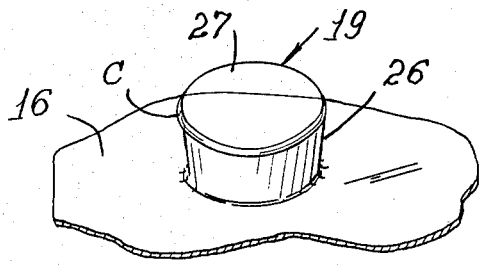
FIG. 5 is a broken-away perspective view of the package of FIGS. 1 and 2 showing the male portion of the improved locking means.
Figure 6:
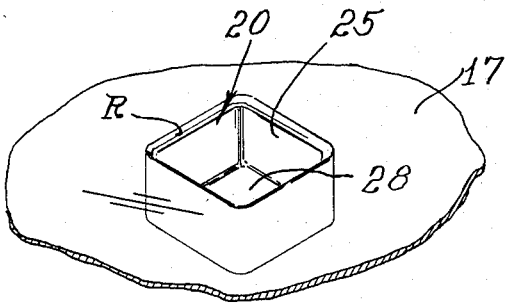
FIG. 6 is a broken-away perspective view of the package of FIGS. 1 and 2 showing the female portion of the improved locking means.

As shown in FIGS. 3A and 3B, male portion 19 has a sidewall 26 molded with a negative draft in the range of from about 1° to about 4°. For the gauges typically used for packaging, a 3° negative draft is preferred. However, as shown in FIG. 3C, male portion 19 may be made with zero draft. Sidewall 26 extends outwardly from edge 16 to terminate in a widened collar C. Collar C, which is slightly exaggerated in the Figures, is formed due to a flowing phenomenon occurring in vacuum forming procedures which causes molten plastic to create a bulb-like transition from sidewall 26 to the flat crown 27 of male member 19. Collar C thus has slightly greater width than the adjacent portion of sidewall 26.

Female portion 20 is preferably molded to have a zero draft sidewall 25. During vacuum forming, the molten plastic at the sidewall juncture with edge 17 bulges inwardly adjacent edge 17 to form a narrowed rim R therearound, which is also slightly exaggerated in the Figures.

It has been discovered that when the sidewall width of the female mold and the crown width of the male mold are roughly the same, narrow rim R is slightly smaller than widened collar C and thereby provides for their snap-engageable association.

Figure 4:
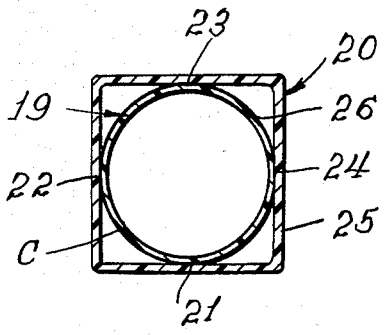
FIG. 4 is another sectional view of the improved locking means taken along line 4—4 of FIG. 3B.

It has also been learned that to take advantage of the phenomenon creating collar C and rim R, the male and female portions should not have geometrically coincident shapes, so that separated points of resilient contact can be established between R and C. In preferred form male portion 19 is generally circular in section and female portion 20 is generally square in section. This arrangement provides resilient symmetrically spaced-apart contact points 21, 22, 23 and 24 to be made between collar C and rim R, as shown in FIG. 4. If, for example, both portions are coincidentally square, or circular, the plastic material at R and C would not permit of sufficient resilience to achieve snap-engagement, since contact would then be completely around the peripheries of R and C and they would tend to deform if forced together. Spaced-apart, preferably symmetric, contact points between collar C and rim R have been found to effectively achieve resilient engagement without crushing or permanently deforming either the male or female portion.

It is envisioned that synthetic resin thermoplastics may be used to form package 10. The thickness of the material is preferably in the range of from about 23 gauge to about 27 gauge, which is a conventional thickness for blister packages. It will be understood that locking means 18 is less thick since it is drawn out from the edges 16 and 17 by vacuum while the plastic is molten. With material having thinner gauges, portions 19 and 20 become too flimsy to offer a secure resilient engagement. With greater thicknesses, the drawn out material tends to become too rigid to properly flex and mate.

Close tolerance mold making is not required for vacuum forming locking means 18. The rim R, collar C, meeting at the spaced-apart points of engagement, plus the effect of the modulus of elasticity of the thermoplastic, cooperate to permit the molds to be made with no greater exactitude than the tolerances required to form the remainder of package 10.

The height of projection 19, i.e., the distance from the flat surface of marginal edge 16 to the flat circular top 27 of the projection, is necessarily no greater than the depth of female portion 20, i.e., the distance from the flat surface of marginal edge 17 to the flat square bottom 28 of the pocket. This relationship allows the marginal edges 16 and 17 to flushly abut and attain a tight closure between sections 11 and 12 when the locking means 18 is snap-engaged. While the particular height of male portion 19 is not otherwise critical, it is preferred that it be greater than one-half the depth of female portion 20 in order to assure that the widened collar C snaps fully past the narrowed rim R to be accommodated within sidewall 25.

Figure 7:
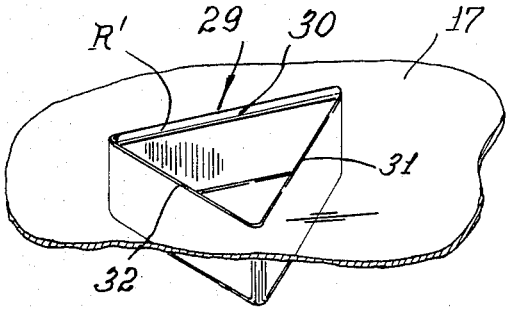
FIG. 7 is a broken-away perspective view of an alternate embodiment for the female portion.
Figure 8:
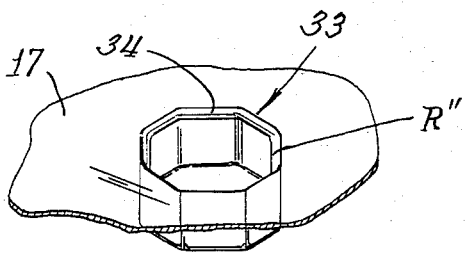
FIG. 8 is also a broken-away perspective view of another alternate embodiment for the female portion.

FIGS. 7 and 8 illustrate two alternate embodiments 29 and 33 for the improved locking means which are equally capable of use with the circular male portion 19. Both female portions 29 and 33 are vacuum formed in the same manner as previously described whereby narrowed rims R′ and R″, respectively, are created to facilitate resilient engagement with widened collar C of the male portion.

FIG. 7 shows female portion 29 which has an equilateral triangular shape in cross-section. When engaging with the male portion 19, three points of contact 30, 31 and 32 on the narrows rim R′ will be made at mid-points of the legs of the triangle shape.

FIG. 8 shows female portion 33 having an octagonal cross-sectional shape. Along the narrowed rim R″, the legs of the octagon will be resiliently contacted by the widened collar C of the male portion at mid-points of the legs, such as exemplified by mid-point 34 on one of the legs.

It will be appreciated that using a circular-sectional shape for the portion 19 allows the female portion to be formed in a number of regular polygonal shapes. For such arrangements, the male portion includes a crown having a radius substantially the same as the dimension taken from the center of the female portion to the mid-points of the legs of its polygonally shaped sidewall. Due to the thickness of the thermoplastic material, and depending upon the widths of the male and female portions, a practical limit is reached for the number of sides that the female portion may have. The limit is reached when the legs become so short that adjacent points of contact nearly merge to substantially create complete contact by the collar on the rim. At that point, flexure of the narrow rim of the female portion is so reduced that the widened collar of the male portion is prevented from snap-engaging. The rim or collar will then become deformed if forced together. For the typically used material thicknesses, 23 to 27 gauge, this practical limit is reached when about twelve points of contact are made. This is considered as about the upper limit of feasibility for collar and rim widths of up to about 0.50 inches. With greater widths, using gauges in the conventional range of from about 23 to 27, the male and female portions are too thin and deformable to effectively engage. Thicker material is then required. As will be understood, with greater material thickness, larger width male and female portions can be formed and the number of sides which the polygon shape may have increases proportionately.

A wide variety of configurations for the locking means is therefore envisioned within the scope of the invention. The embodiments disclosed are exemplary and are not to be understood as limiting the range of equivalents falling within the ambit of the following claims.

What is claimed is:

1. An improvement for plastic packages of the vacuum-formed type having a first package section closable with a second package section and having means for fastening the sections in a closed position, the improvement comprises locking means having at least one set of resiliently engageable male and female portions respectively integrally formed with said package sections, said male portion having a generally cylindrical side wall, said female portion having a side wall which is polygonal in cross section, the side walls of both said portions having non-positive draft, said male and female portions including engagement means adapted to resiliently contact each other during engagement at spaced-apart points.

2. The improvement as in claim 1 wherein the engagement means comprises a widened collar of the male portion and a narrowed rim of the female portion, whereby the collar is snap-engageable with said rim.

3. The improvement as in claim 2 wherein central axes of the male and female portions are co-axial at engagement and wherein the female portion sidewall defines a recess having a size to accommodate the collar of the male portion therein.

4. The improvement as in claim 1 wherein the portions of each said set of locking means resiliently contact at symmetrically spaced-apart points.

5. The improvement as in claim 1 wherein the package sections are joined at hinge means therebetween facilitating pivoting to the closed position.

6. The improvement as in claim 1 wherein the female portion is square in cross section.

7. In a package of the type made by vacuum forming synthetic resin thermoplastic material into a pair of sections adapted to close one upon the other in order to retain an object in a chamber formed therebetween, and having fastening means for securing the sections together, the improvement wherein said fastening means comprise resiliently engaging male and female portions respectively integrally formed with said package sections, said male and female portions each having a continuous side wall formed with non-positive draft, the male portion being circular in cross section and the female portion being polygonal in cross section, the height of the male portion side wall being no greater than the depth of the female portion side wall, and said male and female portions including resiliently engageable means providing spaced-apart snap-engaging contact points.

8. The improvement as in claim 7 wherein at snap-engagement central axes of the male and female portions are co-axial.

9. The improvement as in claim 7 wherein the sidewall of the male portion is integrally formed with a generally flat top crown and an outwardly extending widened collar forming a transition of the crown to the sidewall, and the female portion sidewall having an inwardly extending narrowed rim forming a transition to the the package section from which formed, wherein said widened collar and narrowed rim comprise said resiliently engageable means.

10. The improvement as in claim 9 wherein the snap-engaging contact is made between said widened collar and narrowed rim during engaging and wherein contact points therebetween are evenly spaced apart.

11. The improvement as in claim 7 wherein the package sections are formed from synthetic resin thermoplastic having a thickness of from about 23 gauge to about 27 gauge.

12. The improvement as in claim 7 wherein the female portion is square in cross section.

* * * * *